US011585024B2

(12) United States Patent
Groff

(10) Patent No.: US 11,585,024 B2
(45) Date of Patent: Feb. 21, 2023

(54) YARN BLOCKING AND STORAGE DEVICE

(71) Applicant: Cynthia Groff, Garner, NC (US)

(72) Inventor: Cynthia Groff, Garner, NC (US)

( * ) Notice: Subject to any disclaimer, the term of this patent is extended or adjusted under 35 U.S.C. 154(b) by 126 days.

(21) Appl. No.: 17/197,713

(22) Filed: Mar. 10, 2021

(65) Prior Publication Data

US 2021/0285135 A1 Sep. 16, 2021

Related U.S. Application Data

(60) Provisional application No. 62/988,066, filed on Mar. 11, 2020.

(51) Int. Cl.
*D04B 33/00* (2006.01)

(52) U.S. Cl.
CPC ..... *D04B 33/00* (2013.01)

(58) Field of Classification Search
CPC ..... D04B 3/00; D04B 33/00; D03D 29/00; D04C 7/00; D04G 3/02; B65D 85/24; A47B 87/0215; B43M 99/006; B43M 99/007
USPC ..... 66/3, 4; 139/29, 33; 206/574
See application file for complete search history.

(56) References Cited

U.S. PATENT DOCUMENTS 689,860 A * 12/1901 Dixon ..... D04D 11/00 28/150
744,610 A * 11/1903 Proctor ..... D03D 29/00 28/150
2,011,916 A 8/1935 Simonds
3,044,670 A * 7/1962 Barefoot ..... D04D 7/10 223/46
3,730,601 A * 5/1973 Misenheimer, III ..... A47B 87/0215 108/190
4,045,061 A 8/1977 Fierro
4,103,944 A 8/1978 Alvarado et al.
4,629,100 A * 12/1986 Owens ..... D04D 7/10 223/46
5,193,693 A * 3/1993 Miragliotta ..... B43M 99/006 211/69.5

(Continued)

FOREIGN PATENT DOCUMENTS

KR 20180045151 A * 5/2018 ..... D04B 3/00

OTHER PUBLICATIONS

The Q. "DIY Amazing Pin Art from Wood". Jul. 13, 2018. A YouTube Video. Retrieved from: https://www.youtube.com/watch?v=KHKQEzVy3Ro (Year: 2018).*

(Continued)

*Primary Examiner* — Danny Worrell
*Assistant Examiner* — Aiying Zhao
(74) *Attorney, Agent, or Firm* — Boudwin Intellectual Property; Daniel Boudwin

(57) ABSTRACT

A yarn blocking and storage device is provided. The device includes an upper platform having a first plurality of apertures therethrough and a lower platform having a second plurality of apertures therein. A plurality of support spacers is securable between the upper and lower platforms to maintain the upper and lower platforms in a spaced configuration. A plurality of blocking staves is removably securable through the first plurality of apertures and within the second pluralities of apertures, wherein the plurality of blocking staves can be selectively positioned along the upper and lower platforms to support a motif thereon.

10 Claims, 4 Drawing Sheets

(56) References Cited

U.S. PATENT DOCUMENTS

| | | | | |
|---|---|---|---|---|
| 5,231,742 | A * | 8/1993 | Macbain | D03D 29/00 28/151 |
| 3,316,894 | A1 | 11/2012 | Schaub | |
| 9,695,527 | B1 * | 7/2017 | Clement | D03D 29/00 |
| 2005/0178693 | A1 * | 8/2005 | Gupta | D03D 29/00 206/574 |
| 2010/0218840 | A1 * | 9/2010 | Crorey | D04G 5/00 139/29 |

OTHER PUBLICATIONS

MILWARDS. "MILWARDS Blocking Board with 12 Pins, 30×30×12cm, Wood". Sold on Amazon. Retrieved from: https://www.amazon.com/Milward-Blocking-Board-Pins-30×30×12cm/dp/B07D83Y3MG (Year: 2019).*

MILWARDS. MILWARDS Supplement 2019. Retrieved from: https://mezcrafts.com/wp-content/uploads/2021/12/Milward-Supplement-2019.pdf (Year: 2019).*

* cited by examiner

YARN BLOCKING AND STORAGE DEVICE

CROSS REFERENCE TO RELATED APPLICATIONS

This application claims the benefit of U.S. Provisional Application No. 62/988,066 filed on Mar. 11, 2020. The above identified patent application is herein incorporated by reference in its entirety to provide continuity of disclosure.

BACKGROUND OF THE INVENTION

The present invention relates to yarn blocking devices. More particularly, the present invention pertains to a yarn blocking device that can be configured to support and stretch one or more yarn motifs thereon, while also being adjustable to allow a variety of yarn motif shapes to be supported.

Many individuals enjoy crocheting various projects that include various yarn motifs, however storing and stretching such motifs before assembly into a final project can be difficult. Motifs can be stored in a disorganized manner, leading to misplacing the motifs, or otherwise stored in a location that could possibly damage the motif. Additionally, existing methods of blocking yarn motifs can be inefficient, as providing hand tension can be inconsistent, leading to variations of motif sizes and shapes. As motifs can comprise a variety of shapes, a reconfigurable stable platform for supporting various motif patterns can be particularly useful. Furthermore, many blocking methods require an array of crochet tools, which can be easily misplaced if not stored together. When motifs are not blocked in a uniform manner, it may be necessary to restart the entire motif process. Therefore, a motif blocking device that can allow a user to uniformly block yarn motifs and store the various tools and motifs until final use is necessary.

In light of the devices disclosed in the known art, it is submitted that the present invention substantially diverges in design elements from the known art and consequently it is clear that there is a need in the art for an improvement to existing yarn blocking devices. In this regard, the instant invention substantially fulfills these needs.

SUMMARY OF THE INVENTION

In view of the foregoing disadvantages inherent in the known types of yarn blocking devices now present in the known art, the present invention provides a yarn blocking device wherein the same can be utilized for providing convenience for the user when stably stretching and setting one or more yarn motifs of various configurations.

The present system comprises an upper platform having a first plurality of apertures therethrough and a lower platform having a second plurality of apertures therein. A plurality of support spacers is securable between the upper and lower platforms to maintain the upper and lower platforms in a spaced configuration. A plurality of blocking staves is removably securable through the first plurality of apertures and within the second plurality of apertures, wherein the plurality of blocking staves can be selectively positioned along the upper and lower platforms to support a motif thereon. In some embodiments, a storage tray includes a base, a perimeter sidewall, and an open upper end defining an interior volume, wherein a plurality of compartments is defined within the storage tray dimensioned to store the plurality of blocking staves, the plurality of support spacers, and crochet tools therein. In other embodiments, the storage tray comprises a height less than a distance between the upper and lower platforms when in the spaced configuration, such that the storage tray can be removably secured therebetween.

In some embodiments, the first and second plurality of apertures are disposed in a grid across each of the upper and lower platforms. In another embodiment, a plurality of feet is disposed on a lower surface of the lower platform. In other embodiments, the first plurality of apertures and the second plurality of apertures are coaxially aligned when the upper and lower platforms are in the spaced configuration. In yet another embodiment, each of the plurality of blocking staves comprise an elongated body and a spherical head. In some embodiments, each of the plurality of support spacers comprise a channel therethrough, the channel configured to receive a spacer pin securable within an aperture of each of the first plurality of apertures and the second plurality of apertures. In another embodiment, each of the spacer pins comprise a length less than that of each of the plurality of blocking staves. In other embodiments, at least one well is disposed within an upper surface of the lower platform, wherein the well is dimensioned to receive at least one crochet hook therein. In yet another embodiment, each well is disposed along each edge of the lower platform. In some embodiments, each well further comprises a central depression having a depth greater than that of the well.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
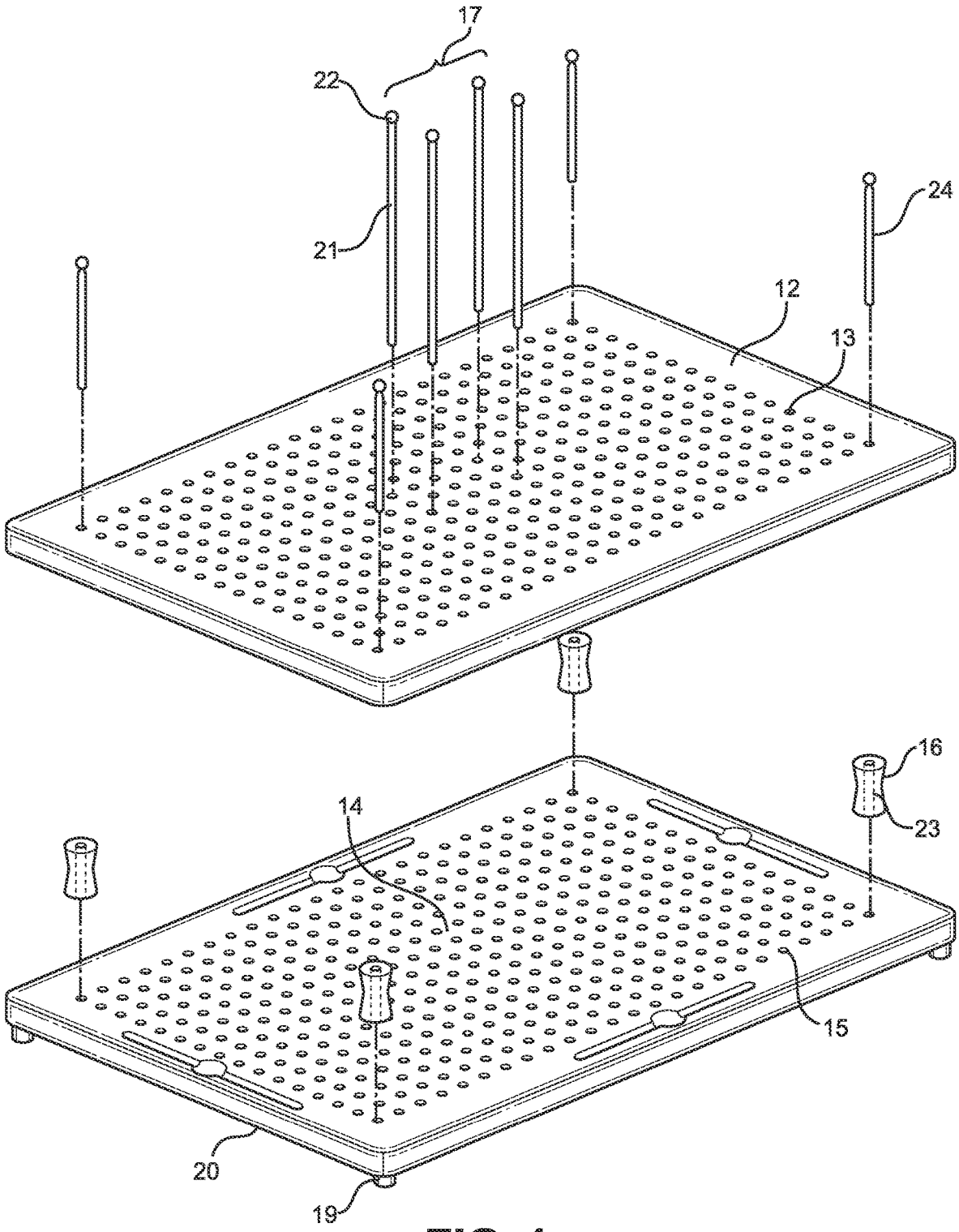
FIG. 1 shows an exploded view of an embodiment of the yarn blocking device.

Reference is made herein to the attached drawings. Like reference numerals are used throughout the drawings to depict like or similar elements of the yarn blocking device. The figures are intended for representative purposes only and should not be considered to be limiting in any respect.

Figure 4:
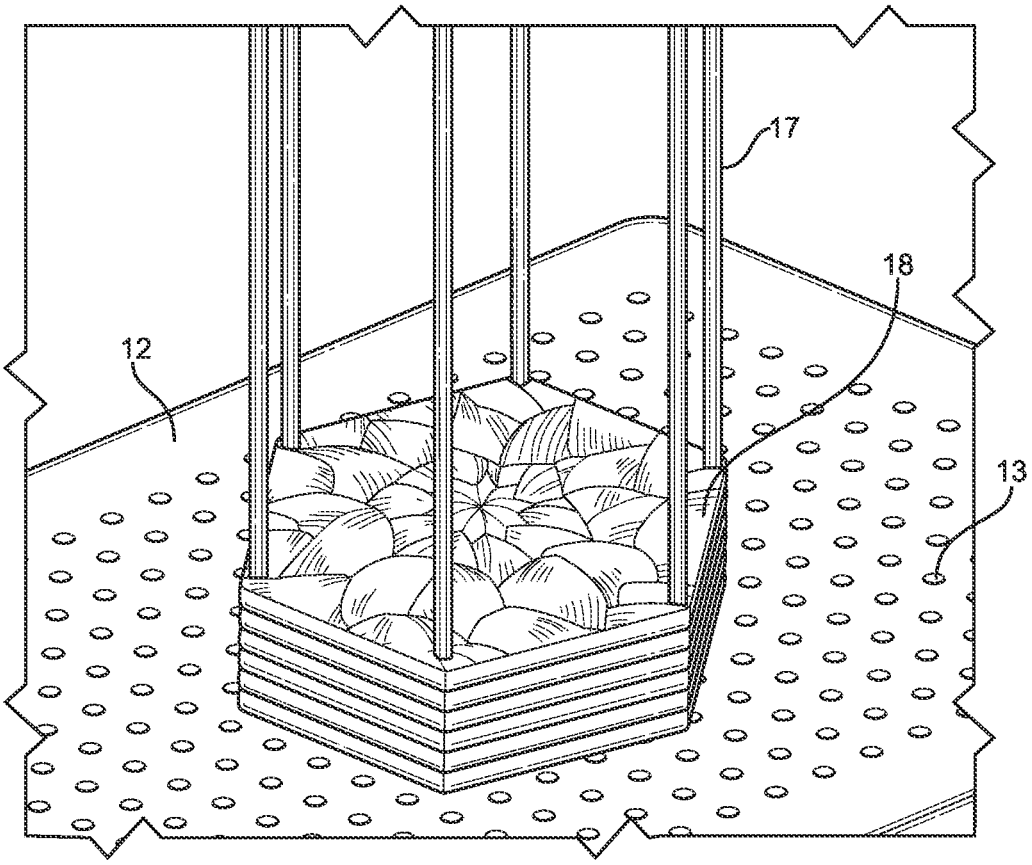
FIG. 4 shows a perspective view of an embodiment of the yarn blocking device in use.

Referring now to FIG. 1, there is shown an exploded view of an embodiment of the yarn blocking device. The yarn blocking device 11 comprises an upper platform 12 and a lower platform 14 having similar dimensions, wherein the upper and lower platforms 12, 14 can be maintained in a spaced configuration apart from one another via a plurality of support spacers 16. A first plurality of apertures 13 are disposed through the upper platform 12 and a second plurality of apertures 15 are disposed within the lower platform 14. In the illustrated embodiment, the first and second pluralities of apertures 13, 15 are disposed in a regular grid across an entirety of each of the upper and lower platforms 12, 14. In this manner, the user can insert a plurality of blocking staves 17 as further described elsewhere herein, in a variety of desired positions to support a yarn motif (as shown in FIG. 4, 18) thereon. In the shown embodiment, when the upper and lower platforms 12, 14 are in the spaced configuration, the first and second pluralities of apertures 13, 15 are coaxially aligned with one another, allowing a linear blocking stave 17 to be inserted through an aperture of each of the first and second pluralities of apertures 13, 15. In some embodiments, the second plurality of apertures 15 comprise a series of blind holes extending partially into the lower platform 14. In this manner, the plurality of blocking staves 17 cannot pass through the lower platform 14 and a lower end of each blocking stave is retained within the second plurality of apertures 15. As such, throughout this specification, where reference is made to the plurality of blocking staves 17 passing through the second plurality of apertures 15, it is contemplated that this can similarly represent the plurality of blocking staves 17 being retained within blind holes that are defined by the second plurality of apertures 15. In the shown embodiment, a plurality of feet 19 are disposed on a lower surface 20 of the lower platform 14. The plurality of feet 19 are configured to increase frictional engagement with a support surface, thereby preventing the lower platform 14 from shifting along the support surface during use. In some such embodiments, the plurality of feet 19 comprise a high friction material, such as rubber, to further increase frictional engagement with the support surface.

The plurality of blockings staves 17 are contemplated to be selectively positioned in a variety of locations through the first and second pluralities of apertures 13, 15. In the shown embodiment, each blocking stave 17 comprises an elongated body 21 having a spherical head 22 on an upper end thereof. The spherical head 22 provides a smooth and gentle surface over which to place a yarn motif, thereby minimizing damage to the yarn motif during placement. Furthermore, the spherical head 22 can comprise a diameter greater than the elongated body 21, thereby ensuring that the yarn motifs remain on the plurality of blocking staves 17 during use. The elongated body 21 is dimensioned to be inserted through the first plurality of apertures 13 and the second plurality of apertures 15, such that the elongated body 21 is supported by each of the upper and lower platforms 12, 14 when in the spaced configuration. In this manner, the plurality of blocking staves 17 are secured to the upper and lower platforms 12, 14 via multiple points of contact, thereby increasing stability of the blocking staves 17. This prevents the plurality of blocking staves 17 from shifting or bending from the vertical position during use.

The plurality of support spacers 16 comprise a body securable between the upper and lower platforms 12, 14 to maintain the upper and lower platforms 12, 14 in a spaced configuration. In the illustrated embodiment, the plurality of support spacers 16 further comprise a channel 23 extending between an upper end and a lower end of each support spacer 16, wherein the channel 23 is configured to receive a spacer pin 24 therethrough. In this manner, the plurality of support spacers 16 can be secured between the upper and lower platforms 12, 14 via aligning the channel 23 with an aperture of each of the first and second pluralities of apertures 13, 15 and inserting the spacer pin 24 therethrough. In the shown embodiment, the spacer pins 24 comprise a length less than that of the plurality of blocking staves 17 to reduce storage space requirements. Similarly, in some embodiments, the spacer pins 24 further comprise a spherical head akin to the plurality of blocking staves 17. In some embodiments, each of the plurality of support spacers 16 comprise a tapered central portion having a width less than that of the upper and lower ends of the support spacers 16, such that the upper and lower ends of the support spacers 16 comprise a larger surface area to frictionally engage each of the upper and lower platforms 12, 14.

Figure 2:
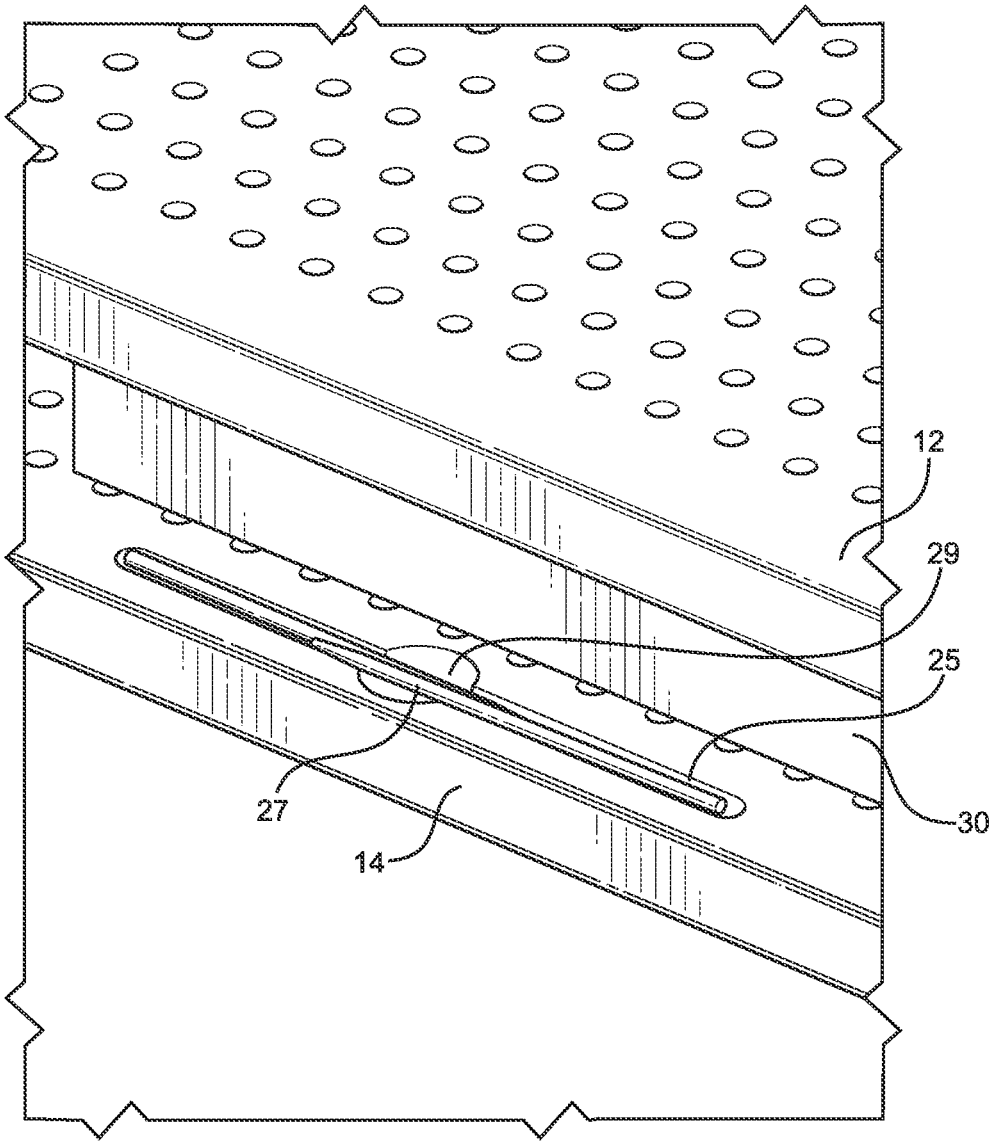
FIG. 2 shows a close-up view of the well of an embodiment of the yarn blocking device.

Referring now to FIG. 2, there is shown a close-up view of the well of an embodiment of the yarn blocking device. In the illustrated embodiment, a well 25 is disposed within the lower platform 14, wherein the well 25 is disposed adjacent and parallel to a lateral edge of the lower platform 14. The well 25 is elongated and dimensioned to receive one or more crochet hooks 27 therein, such that the user can place a crochet hook 27 therein when not in use to prevent he crochet hook 27 from rolling along the support surface. In the shown embodiment, a central depression 29 is disposed along the well 25, wherein the central depression 29 comprises a width and depth greater than that of the well 25. In this manner, the user can insert a finger into the central depression 29 to grasp a crochet hook 27 within the well 25 more readily. In some embodiments, a well 25 is disposed along each lateral edge of the lower platform 14 to increase access to crochet hooks 27 during yarn blocking. In the shown embodiment, a storage tray 30 is stored between the upper and lower platforms 12, 14 in the spaced configuration.

Figure 3:
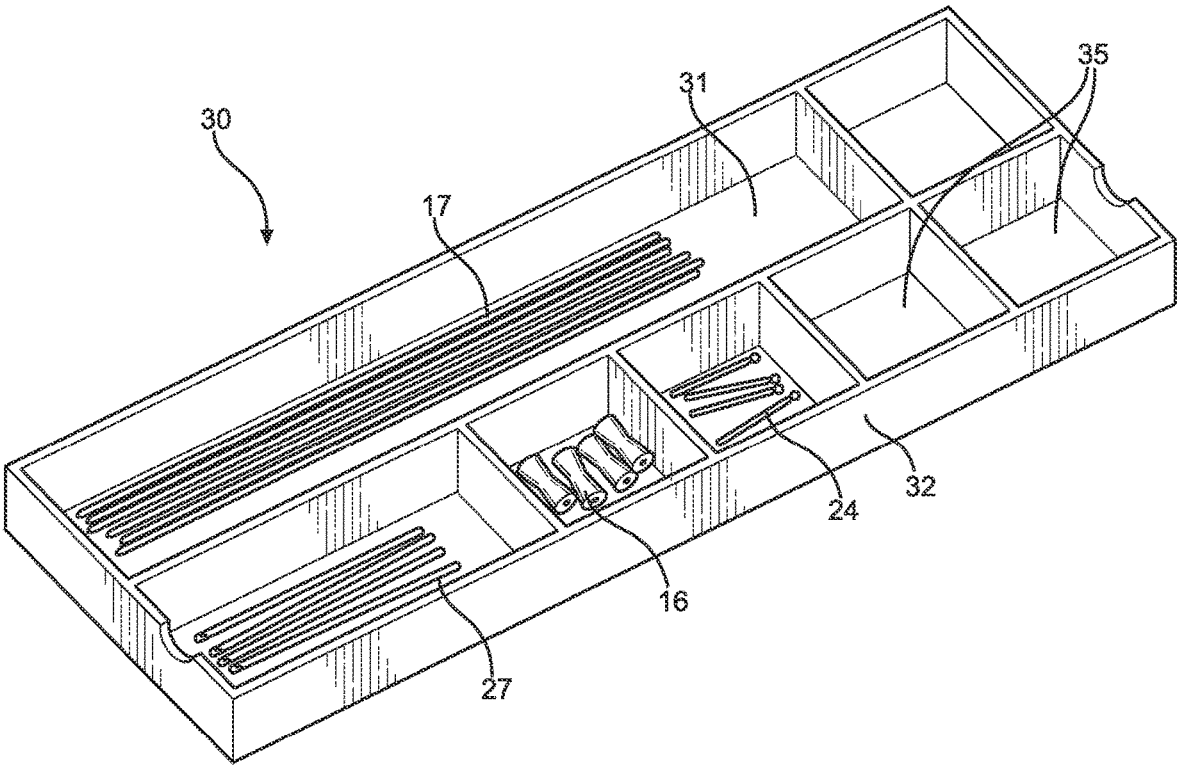
FIG. 3 shows a perspective view of the storage tray of an embodiment of the yarn blocking device.

Referring now to FIG. 3, there is shown a perspective view of the storage tray of an embodiment of the yarn blocking device. In the illustrated embodiment, the storage tray 30 comprises a base 31 having a perimeter sidewall 32 extending therefrom defining an interior volume. A height of the storage tray 30 is contemplated to comprise a height less than a distance between the upper and lower platforms when in the spaced configuration, such that the storage tray 30 is removably stowable between the upper and lower platforms when not in use. A plurality of compartments 35 are defined within the interior volume of the storage tray 30, wherein each of the plurality of compartments 35 is dimensioned to receive one or more components of the yarn blocking system therein. In the shown embodiment, the plurality of compartments 35 are dimensioned to receive the plurality of blocking staves 17, the plurality of support spacers 16, the spacer pins 24, and additional crochet hooks 27. In such embodiments, the compartment storing the plurality of blocking staves 17 may extend across an entirety of the storage tray 30 to allow sufficient storage space to receive the elongated elements. In the shown embodiment, a pair of cutouts are defined within the perimeter sidewall 32 on opposing ends thereof, wherein the pair of cutouts are dimensioned to receive a finger therethrough. In this manner, when the storage tray 30 is stowed between the upper and lower platforms, the user can reach therebetween and grasp the perimeter sidewall 32 via the pair of cutouts to remove the storage tray 30 from between the upper and lower platforms.

Referring now to FIG. 4, there is shown a perspective view of an embodiment of the yarn blocking device in use. In one use, the upper platform 12 is secured over the lower platform via the plurality of support spacers as elsewhere described herein. The plurality of blocking staves 17 can be inserted through the first plurality of apertures 13 and into the second plurality of apertures to stabilize the plurality of blocking staves 17 in a desired pattern. The user can selectively move the plurality of blocking staves 17 to provide a desired amount of tension on yarn motifs 18 installed thereover. In the illustrated embodiment, the plurality of blocking staves 17 are disposed in a hexagonal arrangement to stretch, stabilize, and store yarn motifs 18 of a similar format. As the spherical heads of the plurality of blocking staves 17 present a smooth rounded surface, the yarn motifs 18 can avoid damage that may occur in traditional blocking methods. Furthermore, should the user desire to block multiple styles of yarn motifs 18 simultaneously, the user can place several patterns of blocking staves 17 along the yarn blocking system by retrieving additional blocking staves 17 from the storage tray. When not in use, the storage tray 30 can be placed between the upper platform 12 and the lower platform to minimize storage space required.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly, and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A yarn blocking and storage device, comprising:

an upper platform having a first plurality of apertures therethrough;

a lower platform having a second plurality of apertures therein;

a plurality of support spacers securable between the upper and lower platforms to maintain the upper and lower platforms in a spaced configuration;

a plurality of blocking staves removably securable through the first plurality of apertures and within the second plurality of apertures;

wherein the plurality of blocking staves can be selectively positioned along the upper and lower platforms to support a motif upon the plurality of blocking staves;

wherein the motif comprises a physical structure formed of a yarn;

a storage tray having a base, a peripheral sidewall, and an open upper end defining an interior volume;

wherein a plurality of compartments is defined within the storage tray, the plurality of compartments dimensioned to store the plurality of blocking staves, the plurality of support spacers, and crochet tools therein.

2. The yarn blocking and storage device of claim 1, wherein the first and second plurality of apertures are disposed in a grid across each of the upper and lower platforms.

3. The yarn blocking and storage device of claim 1, further comprising a plurality of feet disposed below a lower surface of the lower platform.

4. The yarn blocking and storage device of claim 1, wherein the first plurality of apertures and the second plurality of apertures are coaxially aligned when the upper and lower platforms are in the spaced configuration.

5. The yarn blocking and storage device of claim 1, wherein each of the plurality of blocking staves comprises an elongated body having a spherical head.

6. The yarn blocking and storage device of claim 1, wherein each of the plurality of support spacers comprises a channel therethrough, the channel configured to receive a spacer pin securable within an aperture of the first plurality of apertures and the second plurality of apertures.

7. The yarn blocking and storage device of claim 6, wherein each of the spacer pins comprises a length less than that of each of the plurality of blocking staves.

8. The yarn blocking and storage device of claim 1, further comprising at least one well disposed within an upper surface of the lower platform, the at least one well dimensioned to receive at least one crochet hook therein.

9. The yarn blocking and storage device of claim 8, wherein the at least one well further comprises a central depression having a depth greater than that of the at least one well.

10. The yarn blocking and storage device of claim 1, wherein a height of the storage tray is less than a distance between the upper and lower platforms when in the spaced configuration, such that the storage tray can be removably secured therebetween.

* * * * *